US006561645B2

(12) United States Patent
Miyamoto

(10) Patent No.: US 6,561,645 B2
(45) Date of Patent: May 13, 2003

(54) IMAGE FORMING PROCESS AND IMAGE FORMING APPARATUS

(75) Inventor: Akio Miyamoto, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/095,049

(22) Filed: Mar. 12, 2002

(65) Prior Publication Data

US 2002/0175986 A1 Nov. 28, 2002

(30) Foreign Application Priority Data

Mar. 13, 2001 (JP) ..... 2001-069941

(51) Int. Cl.[7] ..... B41J 3/407; B41J 2/01

(52) U.S. Cl. ..... 347/106; 347/103; 347/102; 347/100; 347/105

(58) Field of Search ..... 347/106, 102, 347/105, 100, 103

(56) References Cited

U.S. PATENT DOCUMENTS 6,339,442 B1 * 1/2002 Miyamoto et al. ..... 347/171
6,354,701 B2 * 3/2002 Korem ..... 347/106

FOREIGN PATENT DOCUMENTS

| | | | | |
|---|---|---|---|---|
| EP | 0929000 A2 * | 7/1999 | ..... | G03G/13/16 |
| GB | 2 259 888 | 3/1993 | | |
| JP | 62-117782 | 5/1987 | | |
| JP | 5-42755 | 2/1993 | | |
| JP | 7-145576 | 6/1995 | | |
| JP | 7-276780 | 10/1995 | | |
| JP | 11-70633 | 3/1999 | | |
| JP | 2001-105660 | 4/2001 | | |
| JP | 2001-334751 | 12/2001 | | |

OTHER PUBLICATIONS

Hue P. Le, "Progress and Trends in Ink–jet Printing Technology", Journal of Imaging Science and Technology, vol. 42., No. 1, (1998).

* cited by examiner

*Primary Examiner*—Hai Pham
*Assistant Examiner*—Manish S. Shah
(74) *Attorney, Agent, or Firm*—Sughrue Mion, PLLC

(57) ABSTRACT

An image forming process containing the steps of applying imagewisely plural latent image-forming solutions having different concentrations and each containing a material capable of lowering a transfer temperature to one of an image transfer material and an image receiving sheet from plural nozzles, and contacting the transfer recording layer and the image receiving sheet, followed by heating, so as to transfer the latent image portion. Also, an image forming apparatus by such a process.

20 Claims, 4 Drawing Sheets

IMAGE FORMING PROCESS AND IMAGE FORMING APPARATUS

BACKGROUND OF THE INVENTION

1. Field of the Invention

The present invention relates to an image forming process, to which a thermal transfer method is applied, and an image forming apparatus.

2. Description of the Related Art

A method for forming an image on a transfer material, such as paper or a film, includes a thermal transfer method. In the thermal transfer method, a transfer body (transfer sheet), which contains a support and a transfer layer comprising a pigment based dye as a transfer material, is superposed on an image receiving body (an image receiving sheet) such as paper or a film. The superposed bodies are heated imagewisely from the side of the support of the transfer sheet with, for example, a thermal head or a laser head. Due to the heat, the pigment-based dye is transferred to the image receiving sheet to form an image on the image receiving sheet. In another embodiment of the thermal transfer method, a dye provided on a transfer body is transferred to an image receiving sheet due to sublimation of the dye caused by heating.

In the thermal transfer method, those using a thermal head for imagewise heating has such a problem that the distribution of a provided temperature is liable to be nonuniform due to variation of the resistance value of the head, and as a result, an image thus formed suffers unevenness. Further, because high temperature heating is locally carried out with the thermal head only on image portions, such a problem occurs that the support on the heated portions is deformed to get wrinkled. On the other hand, in order to improve uniformity of an image, heating in the thermal transfer method can be carried out with laser light. However, it has problems such that a device for irradiating a laser light or the like is very expensive, and materials such as a dye tend to be decomposed by instantaneous local heating by high temperatures to cause unevenness on an image thus formed.

In contrast to the aforementioned image forming methods, there is a non-contact type image forming method that exerts no influence on an image receiving sheet and a coloring material which forms an image. The method includes an ink-jet method, in which an ink is discharged as droplets to form an image. Type of the ink-jet method includes various types, such as a piezo type, a thermal type and a hertz type, which are described in detail in Journal of Imaging Science and Technology, vol. 42, No. 1 (1998), U.S.A. The piezo type method will be described herein after. In the piezo type ink-jet method, plural nozzle holes with ink heads arranged in parallel, independent discharge chambers interconnected with the nozzle holes and each having a diaphragm as a part of walls, piezoelectric elements attached on the diaphragms and a common ink cavity which supplies an ink to the discharge chambers are comprised. A pulse voltage is applied to the piezoelectric elements in accordance with image information to discharge ink droplets from the nozzle holes, whereby an image is formed on an image receiving sheet.

The ink-jet method dose not involves problems such as the deformation of the support and the deterioration of the coloring material as described above. However, in order to prevent clogging of the nozzle with the ink and form uniform ink droplets in a stable manner, a number of restrictions in property of ink liquid and materials used for forming an image are required. That is, the materials for forming an image cannot be freely selected. Therefore, in the case where a color image is required to be formed, it is necessary to select particular dyes or pigments to prevent clogging of nozzles. Consequently, the hue reproducibility in images is limited, and therefore the method cannot be applied to, for example, a printer for high precision proof printing, which is required to reproduce the same hue on an image receiving sheet as a ink pigment used for printing. Furthermore, the problem of nozzle clogging caused after neglect of a long period of time still remains even when particular image forming materials which are selected carefully are used. There is a further problem that an image thus formed by the ink-jet method is poor in light resistance and water resistance, and the dye is liable to be bled on the image receiving sheet.

Japanese Patent Application Laid-Open (JP-A) No.11-70633 discloses an example of an image forming method, to which the ink-jet method is applied. In this method, droplets of a crosslinking agent are imagewisely applied to a recording layer which is formed with a crosslinkable material by an ink-jet device. An applied portion of the recording layer is hardened by crosslinking, and a non-crosslinked portion of the crosslinkable material is then removed by washing to form an image portion. This method is a method to form a so-called screen printing plate by using the ink-jet, followed by forming an image by using a colored ink with the plate. It is completely different from the transfer method of the present invention since it contains two steps, plate making and printing. Further, the method involves a problem of processing of waste liquids after washing because a developing step is necessary upon plate making, whereby complicated steps are required.

Additionally, a transfer ink-jet system is proposed, for example, in JP-A No.5-42755, in which an image is formed on an image carrying member with a recording liquid which contains a liquid and a coloring agent by an ink-jet recording system, and the image is transferred to a transfer material. In this transfer ink-jet method, an image containing a coloring agent is once formed on an image carrying member on, for example, a drum by ordinary ink-jet method, and then the image is then transferred to the transfer material. Therefore, this method is different from the present invention and involves the same problems as in the ordinary ink-jet methods, i.e., the restriction of coloring materials and the clogging of nozzles. Furthermore, the method provides only an image that is liable to be bled and is of low resolution.

An image forming method utilizing an ink-jet method using a transfer medium is described in JP-A No.7-145576. In this method, an ink-jet ink is spotted imagewisely on a transfer medium having a liquid-reactive resin layer as an uppermost layer by an ink-jet recording device. Therefore, the transfer medium is closely attached to an image supporting body (such as cloth), and heat and pressure are applied thereto, so as to transfer image portions. It is such an image forming method that is particularly possible to textile-print on cloth. For example, in the case where the ink is an aqueous ink, the liquid-reactive resin layer is formed with a water soluble resin, and when an ink droplet is spotted thereon, the resin on the spotted portion is dissolved to have cohesiveness (adhesiveness). Owing to the cohesiveness, transfer occurs only on the spotted portion by the heat and pressure. Therefore, high precision image formation becomes possible on cloth by using the ink-jet method. However, this method particularly targets cloth as an image carrying member, and still uses the ink-jet method.

Accordingly, it involves the same problems as in the ordinary ink-jet methods, i.e., the restriction of coloring materials and the clogging of nozzles. Furthermore, it also involves such a problem that transfer of the resin layer cannot be carried out uniformly to cause unevenness.

Moreover, JP-A No.62-117782 describes the following image forming method. In the method, a solvent is applied imagewisely to a surface of an image carrying member by an ink-jet discharge system, and then an ink layer is made in contact with the image carrying member, whereby only the part of the ink layer that has been contacted with the imagewise solvent is formed on the image carrying member. However, as described in the right upper column of page 4, lines 7 to 16, of the publication, selection of the solvent is difficult because such a solvent is required that has suitable cohesion and adherence. Furthermore, a synthetic resin film is disclosed in the publication as the image carrying member, and it is difficult for the film to obtain good and stable transfer property because the film does not have solvent acceptability, unlike a binder coating layer. Furthermore, this method is insufficient in reproducibility of minute dots, and it is particularly impossible to obtain a multi-color transfer image of high resolution.

JP-A No.7-276780 describes a method that is an improvement of the method described in aforementioned JP-A No.62-117782. In this method, in order to apply a solvent imagewisely to a recording medium, heat energy is applied to a porous body comprising a solvent impregnated therein in accordance with image information, so as to discharge the solvent as mist (microdroplets) or vapor on the image recording medium. This method has such an advantage that clogging does not occur since the ink-jet discharge system is not used. However, this method is based on the same technique as those described in JP-A No.62-117782 as noted above except that mist or vapor is applied to the recording medium, and therefore, the same problems remain.

In order to solve the problems, the inventors of the present invention proposed an image forming method which utilizes an image transfer material containing a support having provided thereon a transfer recording layer which contains a thermal transfer material, and an image receiving sheet having an image receiving layer which contains a binder resin. In this method, a liquid containing an adhesive material or transfer-promoting material that lowers the transfer temperature of the thermal transfer material (a latent image-forming solution) is applied imagewisely and substantially to a surface of the transfer recording layer of the image transfer material or an image receiving surface of the image receiving sheet, so as to form a latent image. Thereafter, the surface of the transfer recording layer of the image transfer material and the image receiving surface of the image receiving sheet are closely in contact with each other, followed by heating, whereby the transfer recording layer corresponding to the latent image is transferred to the image receiving sheet (as described in Japanese Patent Application Nos.12-163273 and 11-288179).

According to the image forming method, the problems of the restriction of image forming material and the clogging of nozzles, which are the disadvantages of the ink-jet system, are solved, and the damage of the support due to heat and unevenness of the image, which are the disadvantages of the thermal transfer system, are also solved. Furthermore, an image which is excellent in hue reproducibility can be formed, and excellent resolution of image can be obtained. Particularly, in the case where a multi-color image is formed by the image forming method, an image can be obtained such that it is considerably excellent in comparison with the conventional transfer methods. However, it is the current situation that the demand for improving the image quality is becoming more severe, and it is desired that problems such as phenomena described below should be avoided. One phenomenon is that, when both a region where such images as highlights, microdots and/or microlines are formed and a region where images of high gradient and/or high image density are formed are provided by using the same latent image-forming solution, the latent image-forming solution tends to be insufficiently attached to the region where images such as highlights, microdots and microlines are formed, and a lack of dots and a ring stain (i.e., only a fringe of a dot becomes dense in a ring form) occur, and make the image, formation insufficient. Further, another phenomenon is that, in the case where the liquid containing the transfer-promoting material as the latent image-forming solution is used for forming a multi-color image, when the next color is to be superposed on a image-portion having high gradient (high garadatiopn) or high image density, there are some cases where unpreferable fogging (secondary fogging) occurs due to a remaining latent image-forming solution corresponding to the previous color. However, in order to avoid the secondary fogging, the load for drying the latent image-forming solution must be increased.

SUMMARY OF THE INVENTION

An object of the present invention is to further improve an image quality in the foregoing image forming method. The present invention provides an image forming process in that plural latent image-forming solutions each having concentration different from each other are discharged from plural nozzles. The process provides satisfactory image formation which can be carried out for any image condition such that the image forming region is (i) a high light portion and/or a microimage portion, or (ii) a high gradation portion and/or a high image density portion, and the image formation is carried out with high resolution setting or low resolution setting. The present invention also provides an image forming apparatus utilizing the image forming process.

A first aspect of the present invention is an image forming process comprising:

(i) preparing an image receiving sheet, an image transfer material and at least two latent image-forming solutions, the image receiving sheet comprising an image receiving layer which contains a binder resin, the image transfer material comprising, on a support, a transfer recording layer which comprises a thermal transfer material, the latent image-forming solutions respectively comprising at least one of an adhesive material and a transfer-promoting material which is capable of lowering a transfer temperature of the thermal transfer material, one of the latent image-forming solutions having a lower concentration of the at least one of an adhesive material and a transfer-promoting material than another of the latent image-forming solutions;

(ii) forming a latent image by imagewisely applying the latent image-forming solutions from a plurality of nozzles to at least one of a transfer recording layer surface of the image transfer material and an image receiving layer surface of the image receiving sheet; and (iii) transferring the portion of the transfer recording layer that corresponds to the latent image to the image receiving sheet, by contacting and heating the transfer recording layer surface with the image receiving layer surface.

A second aspect of the present invention is an image forming apparatus for imagewisely transferring a transfer recording layer of an image transfer material to an image receiving sheet. The image transfer material comprises the transfer recording layer on a support, the transfer recording layer comprising a thermal transfer material, and the image receiving sheet comprises an image receiving layer that contains a binder resin. The apparatus comprises: a nozzle head including a plurality of nozzles supplied with at least two latent image-forming solutions and disposed to discharge the latent image-forming solutions towards at least one of a transfer recording layer of the image transfer material and an image receiving layer surface of the image receiving sheet, the latent image forming solutions respectively including at least one of an adhesive material and a transfer-promoting material which is capable of lowering a transfer temperature of the thermal transfer material, the latent image forming solutions having different concentrations; and a pair of pressure rollers disposed on the conveyance path downstream of the nozzle head such that when the pressure rollers are rotated the image transfer material and the image receiving sheet are passed between the pressure rollers with the transfer recording layer surface and the image receiving layer surface being pressed together, at least one of the pressure rollers including heating means whose heating temperature is controllable.

DESCRIPTION OF THE PREFERRED EMBODIMENTS

Figure 1:
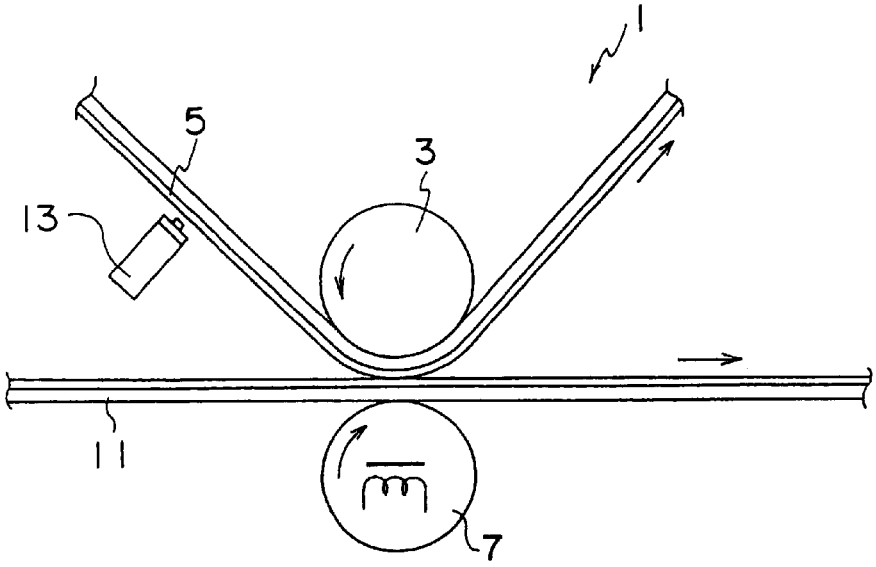
FIG. 1 is a conceptual view showing one embodiment of an image forming apparatus according to the present invention.

According to the present invention, the selective range of the image transfer materials can be largely broadened, and image formation with a light-resistant pigment, a functional inorganic material and the like becomes possible by using a latent image-forming solution as described in Japanese Patent Application Nos.12-163273 and 11-288179. Further, in accordance with the present invention, an image with high color reproducibility can be formed, and an excellent uniform image without color unevenness can be formed, since it does not suffer unpreferable influences of temperature distribution caused by thickness unevenness of the support, contact unevenness of a thermal head and diffusion unevenness of heat, as in the conventional transfer methods. Furthermore, the method has such an effect that damage of the support of the receiving sheet is decreased since the transfer temperature can be lowered. Moreover, satisfactory image formation can be carried out whether the image forming region is a highlight portion or a microimage portion, or a high gradient portion or a high image density portion of image, and whether the image formation is carried out with high resolution setting or low resolution setting. The present invention also provides an apparatus which can form an excellent image utilizing the image forming method even when any setting and/or image is required.

In more detail, a latent image-forming solution of higher concentration is discharged to an image forming region which forms a microimage portion, such as a high light portion, a minute image portion, a microdot portion and a microline portion of images, and on the other hand, a latent image-forming solution of lower concentration is discharged to an image forming region which forms a high gradation portion and/or a high image density portion of images, whereby lack of dots and ring stain are prevented to obtain an image of higher quality. In the case where a liquid containing a transfer-promoting material, which lowers the transfer temperature, is used as the latent image-forming solution to form a multi-color image, the secondary fogging can be prevented. Furthermore, the process is advantageous from the standpoint of the load for drying the latent image-forming solution.

The terms "low concentration" and "high concentration" herein means such a situation that they have a relative difference from each other in concentration, but does not indicate any specific concentration. These concentrations vary depending on the materials used and the performance of the drying device used. In the case where two kinds of liquids having different concentrations are used, in general, it is preferred that a ratio of a concentration (percent by mass) of the liquid of "high concentration" to the liquid of "low concentration" is from 1.2:1 to 10:1. In the case where three kinds of liquids having different concentrations are used, it is preferred that ratio of concentration of 1:1.2–3:5–10.

More specifically, in the case where two kinds of liquids having different concentrations of the transfer-promoting material are used, a liquid having a concentration of the transfer-promoting material of about from 1 to 5% by mass can be used as the liquid of "low concentration", and a liquid having a concentration of about from 3 to 10% by mass can be used as the liquid of "high concentration". In the case where two kinds of liquids having different concentrations of the adhesive material, a liquid having a concentration of the adhesive material of about from 1 to 10% by mass can be used as the liquid of "low concentration", and a liquid having a concentration of about from 5 to 30% by mass can be used as the liquid of "high concentration".

In the case where three kinds of liquids having different concentrations of the transfer-promoting material, a liquid having a concentration of about from 1 to 3% by mass, a liquid having a concentration of about from 2 to 5% by mass and a liquid having a concentration of about from 4 to 10% by mass in that order from the low to high concentrations can be used. In the case where three kinds of liquids having different concentrations of the adhesive material, a liquid having a concentration of about from 1 to 3% by mass, a liquid having a concentration of about from 2 to 10% by mass and a liquid having a concentration of about from 5 to 30% by mass can be used.

In the present invention, the number of liquids is not particularly limited so long as two or more kinds of latent image-forming solutions having different concentrations are used. In the case where a large number of liquids are used, the concentrations thereof can be appropriately determined by considering lack of dots, ring stain, secondary fogging and resolution.

In general, when the concentration of the latent image-forming solution is too low, the latent image forming capability (effect of imparting transferability) is failed, and on the other hand, when it is too high, deterioration in drying property and decrease in resolution are liable to occur and the nozzles are liable to be clogged when the adhesive material is used. Therefore, it is necessary that the plural liquids of different concentrations be prepared taking these factors into consideration.

In the image forming process according to the present invention, satisfactory image formation can be carried out whatever resolution is set. That is, it is preferred that a liquid of low concentration is discharged in the case where high resolution is set, and a liquid of high concentration is discharged in the case where low resolution is set. In the case of an intermediate resolution, it is possible to discharge both the liquids of low concentration and high concentration or a liquid of intermediate concentration. The terms "high resolution" and "low resolution" herein have relative meanings but do not indicate any specific resolution. The number of settings of resolution may be two or more.

For example, in the case where two settings of 360 dpi and 720 dpi are possible as a resolution, and an image is formed by using the transfer promoting-material as the latent image-forming solution, a concentration of the transfer-promoting material of about from 1 to 5% by mass is suitable for forming an image of 360 dpi, and a concentration of from 3 to 10% by mass is suitable for forming an image of 720 dpi. In the case where an image is formed by using the adhesive material, a concentration of the adhesive material of from 5 to 30% by mass is suitable for forming an image of 360 dpi, and a concentration of from 1 to 10% by mass is suitable for forming an image of 720 dpi.

In the case where image formation is carried out by setting a resolutions and using the latent image-forming solutions having the set concentrations as described above, plural latent image-forming solutions with difference in concentration that is not adverse to the foregoing ranges may be used depending on whether the image forming region is a high light portion or a microimage portion, or it is a high gradation portion or a high image density portion of the image.

The plural nozzles (discharge head) are each constituted by plural nozzles which can discharge liquids of different concentrations respectively. The plurality of nozzles can includes nozzles of different types, and the higher concentration latent image-forming solution can be applied from one of the nozzle type, and the lower concentration latent image-forming solution can be applied from another of the nozzle types. For example, in the case where the image forming region is a high light portion or microimage portion of an image, the discharge is carried out mainly from a group of nozzles for discharging a high concentration liquid, and in the case where the image forming region is a high gradation portion or a high image density portion, the discharge is carried out mainly from a group of nozzles for discharging a low concentration liquid. In the intermediate region between them, and/or an image part other than a high light portion, a microimage portion, a high gradation portion and a high image density portion, and/or a part where a high light portion or a microimage portion and a high gradation portion or a high image density portion are mixed, the liquid may be discharged from both the groups of nozzles depending on the extent thereof. That is, both the high concentration liquid and the low concentration liquid may be discharged to the image part where the high concentration liquid and the low concentration liquid are not discharged solely. In alternative, an intermediate concentration liquid may be discharged thereto. The higher concentration latent image-forming solution may be applied from smaller nozzles, and the lower concentration latent image-forming solution may be applied from larger nozzles. In the case where image formation is carried out with set specified resolution and/or gradients (gradation), each of the relative speeds of the main scanning and the subscanning can be set with respect to the latent image forming surface corresponding to the number of resolutions and/or gradients specified. Based on the respective settings, the latent image-forming solution may be discharged mainly from the group of nozzles for low concentration in the case of high resolution recording, and the latent image-forming solution may be discharged mainly from the group of nozzles for high density in the case of low resolution recording. However, the latent image-forming solution may be discharged only from the group of nozzles for low concentration in the case of high resolution recording, and the latent image-forming solution may be discharged only from the group of nozzles for high density in the case of low resolution recording. In these cases, latent image-forming solutions having different concentrations may be discharged from the respective groups of nozzles simultaneously in accordance with a state of the image forming regions which include a high light portion or a microimage portion, and/or a high gradation portion or a high image density portion.

Figure 6:
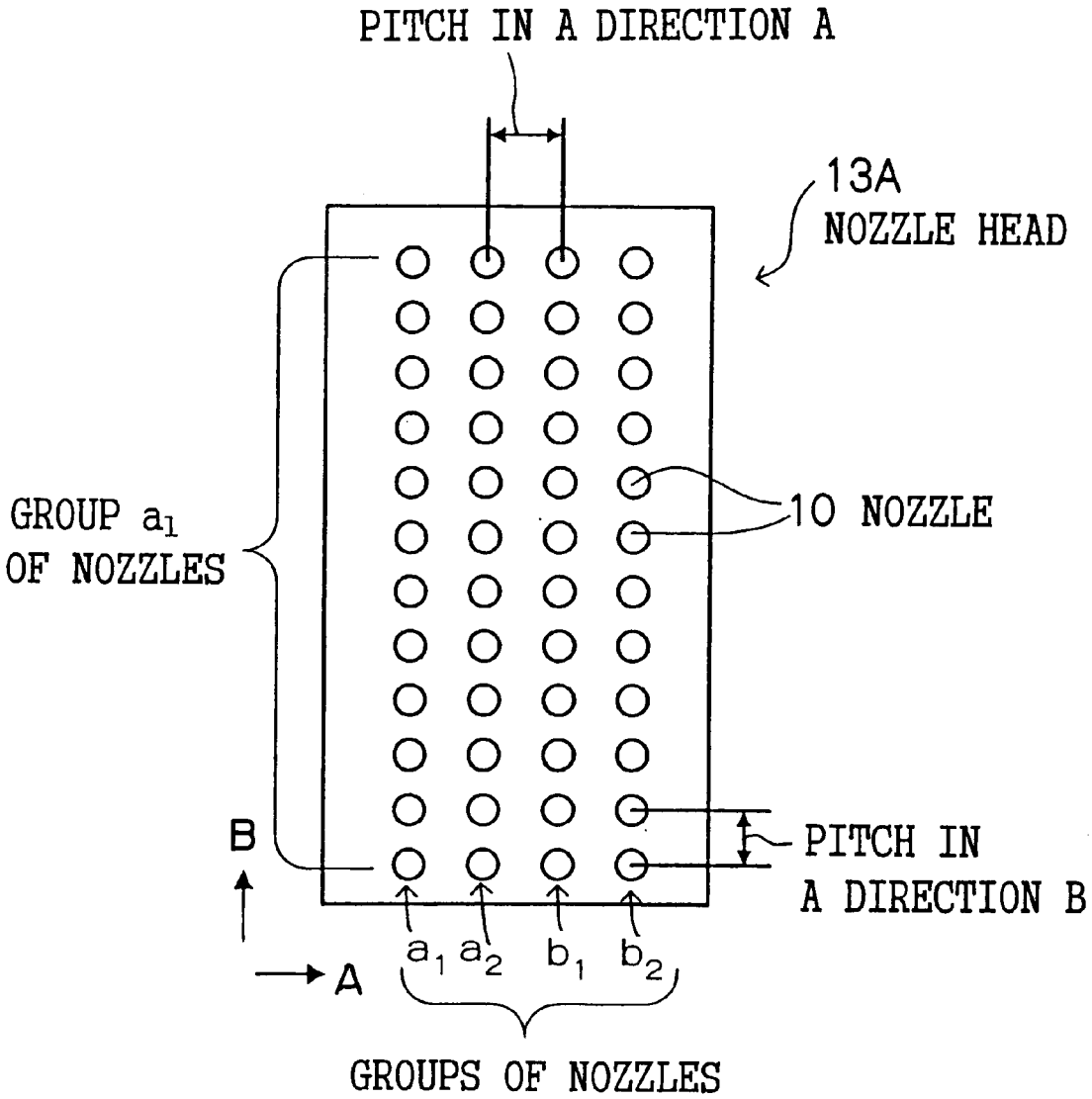
FIG. 6 is a conceptual view showing one example of a nozzle head having plural nozzles provided therein which is usable in the image forming process according to the present invention.

FIG. 6 is a view showing one example of a nozzle head having plural groups of nozzles provided therein. In the view, a nozzle head 13A has four groups of nozzles, in which symbols $a_1$ and $a_2$ denote groups of nozzles for discharging a high concentration liquid, and symbols $b_1$ and $b_2$ denote groups of nozzles for discharging a low concentration liquid. The groups of nozzles each have twelve of nozzle 10, i.e., the nozzle head 13 has 48 nozzles in total.

In the image forming process using a latent image-forming solution as in the present invention, it is not necessary to provide some kinds of nozzles which correspond to the number of colors and have extremely small nozzle pitches as in the ink-jet method, and a system for supplying an ink of the image forming method of the present invention does not become complicated. Therefore, it is advantageous that a nozzle head can be produced in a relatively simple manner for the present invention.

[Latent Image-Forming Solution]

The latent image-forming solution used in the present invention will be described in detail below. The latent image-forming solution contains an adhesive material or a transfer-promoting material that lowers the transfer temperature of the thermal transfer material.

(1) Latent Image-Forming Solution Containing Transfer-Promoting Material that Lowers Transfer Temperature of Thermal Transfer Material In the image forming process according to the present invention, a solution containing a solvent and at least one transfer-promoting material dissolved therein, such as various kinds of surfactants, an organic solvent having compatibility with water and having a boiling point of 100° C. or more at ordinary temperature and ordinary pressure, is preferably used as the latent image-forming solution.

By using the organic solvent having a boiling point of 100° C. or more under ordinary temperature and ordinary pressure and having compatibility with water as the transfer-promoting material, the discharge stability of the solution is improved, and therefore discharge failure upon forming a latent image and upon restarting after waiting can be prevented. Furthermore, transfer property of microdot images is improved to obtain a high resolution image.

Examples of the organic solvent having a boiling point of 100° C. or more under ordinary temperature and ordinary pressure and having compatibility with water include monovalent or polyhydric alcohols, such as ethylene glycol, diethylene glycol, thiodiethylene glycol, triethylene glycol, polyethylene glycol, propylene glycol, polypropylene glycol and glycerin, ethers, such as ethylene glycol monomethyl ether, ethylene glycol monoethyl ether, ethylene glycol monobutyl ether, diethylene glycol monomethyl ether, diethylene glycol monoethyl ether, ethylene glycol diethyl ether, propylene glycol monomethyl ether, propylene glycol monoethyl ether, propylene glycol monobutyl ether, triethylene glycol monoethyl ether, triethylene glycol monobutyl ether and tripropylene glycol monomethyl ether, keto alcohols, such as diacetone alcohol or the like, and nitrogen-containing solvents, such as N-methyl-2-pyrrolidone and 2-pyrrolidone.

As the material that lowers the transfer temperature in the present invention, there are various kinds of surfactants those are miscible with water. As the surfactant which can be miscible with water, any of anionic, cationic, nonionic and amphoteric surfactants may be selected and used corresponding to the characteristics of the thermal transfer material used. Specific examples thereof include an aliphatic acid salt, an alkylsulfate, a polyoxyethylene alkylether sulfate, an alkylbenzene sulfonate, an alkylnaphthalene sulfonate, an alkyl sulfosuccinate, an alkyl diphenyl ether disulfonate, an alkyl phosphate, a naphthalene sulfonate formalin condensate, a polyoxyethylene alkyl ether, a polyoxyethylene alkylene alkyl ether, a polyoxyethylene fatty acid ester, a polyoxyethyelene alkylamine, an alkylalkanolamine, an alkylamine salt and an alkyl betain. These may be used singly or in combination of two or more.

In the image forming process according to the present invention, when a nonionic surfactant is used as the transfer-promoting material, the effect of lowering the transfer temperature is large, and the transfer property of microdots is good, whereby a transfer image of high resolution can be obtained. While the reason thereof is not clear, it is considered that the nonionic surfactant is good in wettability and good in permeability with the transfer layer or the image receiving layer and therefore can form a sharp latent image of microdots, and when the surfactant is permeated into the transfer layer or the image receiving layer, it exerts high effect as a plasticizer to the resins used in the layer and can provide excellent adhesiveness on the latent image portion due to heat, whereby the transfer effect is exhibited. Furthermore, such an effect is also considered that the permeated nonionic surfactant is arranged at the interface between the support and the coated layer (transfer recording layer) of the transfer layer to induce release and transfer.

It has been found that as the nonionic surfactant, a nonionic compound having an ethylene oxide group as a hydrophilic group exerts a large effect of lowering the transfer temperature of the latent image portion, and an image of high resolution can be obtained. Examples of the nonionic compound include compound represented by the following general formulae 1 to 4:

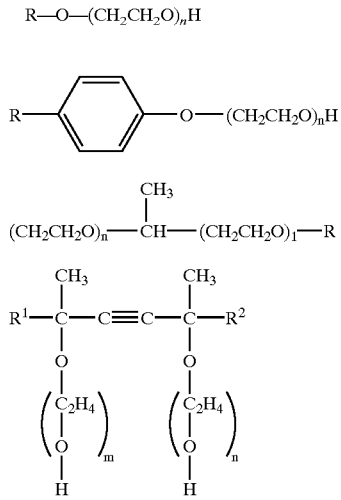

General formula 1

General formula 2

General formula 3

General formula 4

In the general formula I, R represents an alkyl group or an alkylene group, and n represents an integer of from 2 to 30, and preferably from 2 to 20. In the general formula II, R represents an alkyl group, and n represents an integer of from 2 to 30, and preferably from 2 to 20. In the general formula III, R represents an alkyl group or a hydrogen atom, and n and 1 each represents an integer of from 2 to 30, and preferably from 2 to 20. In the general formula IV, $R^1$ and $R^2$ each represents a hydrogen atom or an alkyl group, and m and n each represents an integer of from 2 to 30, and preferably from 2 to 20.

In the general formulae I to IV, the addition number of ethyleneoxide is preferably from 2 to 30, and particularly preferably from 2 to 20.

Specific examples of the compounds represented by the general formulae 1 to 4 include polyoxyethylen (4) lauryl ether, polyoxyethylene(7) cetyl ether, polyoxyethylene(13) stearyl ether, polyoxyethylene(5) oleyl ether, polyoxyethylene(10) nonylphenyl ether, an ethyleneoxide-propyleneoxide copolymer (n=10, l=7) and an ethyleneoxide adduct of acetylene glycol (n+m=10), but the compounds are not limited to them.

The transfer-promoting material preferably does not contain a solid pigment or a compound that may be deposited with the lapse of time, from the standpoint of storageability time lapse stability and avoidance of clogging of nozzles. Furthermore, in the case where a coloring material is used in the transfer recording layer, it is preferred that the transfer-promoting material is such a material that does not react with the coloring material and does not cause a coloring reaction upon application of energy such as heating, and the transfer-promoting material is colorless, transparent, translucent or hypochromic material by itself, from the standpoint of avoidance of influence of the transfer-promoting material on the color tone.

The transfer-promoting material (i.e., the organic solvent having a boiling point of 100° C. or more under ordinary temperature and ordinary pressure and having compatibility with water and/or various kinds of surfactants) may be used singly or in combination of two or more kinds thereof.

The latent image-forming solution containing the transfer-promoting material can be prepared as two or more latent image-forming solutions having different concentrations through adjustment of the concentration of the transfer-promoting material.

To the latent image-forming solution containing the transfer-promoting material, an organic solvent that is freely miscible with water may be added. Specific examples of the organic solvent that is freely miscible with water include a monovalent or polyhydric alcohol, such as methyl alcohol, ethyl alcohol, n-propyl alcohol, isopropyl alcohol, n-butyl alcohol, sec-butyl alcohol, isobutyl alcohol, ethylene glycol, diethylene glycol, thiodiethylene glycol, triethylene glycol, polyethylene glycol, propylene glycol, butylene glycol, 1,2,6-hexanetriol, hexylene glycol, polypropylene glycol and glycerin, an ether, such as ethylene glycol monomethyl ether, ethylene glycol monoethyl ether, ethylene glycol monobutyl ether, diethylene glycol monomethyl ether, diethylene glycol monoethyl ether, ethylene glycol diethyl ether, propylene glycol monomethyl ether, propylene glycol monoethyl ether, propylene glycol monobutyl ether, triethylene glycol monoethyl ether, triethylene glycol monobutyl ether and tripropylene glycol monomethyl ether, a keto alcohol, such as diacetone alcohol, and a nitrogen-containing solvent, such as N-methyl-2-pyrrolidone and 2-pyrrolidone. These solvents may be used singly or in a combination of two or more.

The content of the water soluble organic solvent is preferably from 0 to 90% by mass, more preferably from 5 to 85% by mass and most preferably from 10 to 70% by mass in the solution. In particular, when the content of a solvent having a boiling point of 100° C. or more is large, the discharge stability upon forming a latent image may be improved, but the drying property of the transferred image is lowered. Therefore, the suitable species of the solvent and the suitable using amount thereof can be determined depending on the necessity of drying of the transfer body and the drying capability of the apparatus.

The latent image-forming solution containing the transfer-promoting material may further contain a surface tension adjusting material, an antimold material, a viscosity adjusting material, such as a polymer, a pH adjusting material and a defoaming material in order to adjust the discharge suitability, to improve the storage stability of the liquid, and to prevent diffusion of sprayed droplets.

(2) Latent Image-Forming Solution Containing Adhesive Material

A latent image-forming solution containing an adhesive material in the present invention will be described. The adhesive material referred herein designates a substance having adhesiveness at ordinary temperature or upon heating, and a representative example thereof is an organic polymer. Specific examples thereof include a homopolymer or a copolymer of an acrylic monomer, such as acrylic acid, methacrylic acid, an acrylate or a methacrylate, a homopolymer of a vinyl monomer, such as polyvinyl acetate, polystyrene, polyvinyl pyrrolidone, polyvinyl butyral, polyvinyl alcohol or polyvinyl chloride, a copolymer thereof, such as an ethylene-vinyl acetate copolymer, a condensation polymer, such as polyester or polyamide, and a rubber type polymer, such as a styrene-butadiene copolymer or an acrylonitrile-butadiene copolymer. Among them, a polymer having a glass transition point (Tg) of less than 90° C. is preferred. The polymer may be used in the form of an emulsion in water, i.e., so-called latex.

The latent image-forming solution containing the adhesive material is a liquid containing water or an organic solvent having the adhesive material which is dissolved or dispersed (including solid dispersion and emulsion dispersion) therein. Specific examples of the organic solvent include alkyl alcohols, such as methyl alcohol, ethyl alcohol, n-propyl alcohol and i-propyl alcohol, amides, such as dimethylformamide and dimethylacetamide, monovalent or polyhydric alcohols, such as ethylene glycol, 1,2,6-hexanetriol, thiodiglycol, propylene glycol, diethylene glycol, triethylene glycol, polyethylene glycol, polypropylene glycol and glycerin, ethers, such as dioxane, ethylene glycol monomethyl ether, ethylene glycol monobutyl ether, propylene glycol monobutyl ether, triethylene glycol monobutyl ether and tripropylene glycol monomethyl ether, and a ketone or a ketoalcohol, such as acetone, methyl ethyl ketone and diacetone alcohol.

The latent image-forming solution containing the adhesive material is prepared as two or more latent image-forming solutions having different concentrations through adjustment of the concentration of the adhesive material.

Water and the organic solvent may be used singly or as a mixture of plural kinds thereof in order to dissolve or disperse the adhesive material. The solution may further contain a surface tension adjusting material, an antifungul material, a viscosity adjusting material, a pH adjusting material, a defoaming material and a plasticizer in order to improve the discharge suitability, the storage stability of the liquid and the adhesive characteristics.

In the case where the latent image-forming solution of the present invention contains the adhesive material in the form of dispersion (i.e., solid dispersion and emulsion dispersion), it is preferred to add a compound represented by a following general formula (I) to the dispersion. By adding the compound (I), the adhesive material in the form of dispersion does not suffer aggregation, but the latent image-forming solution is maintained in a stable state, and occurrence of clogging of nozzles can be prevented. The compound represented by the general formula (I) may be added in an amount of 3 to 20% by mass, preferably 3 to 15% by mass and more preferably 3 to 10% by mass, based on the solid content of the latent image-forming solution:

$$R—(S—P)_n \qquad (I)$$

In the general formula (I), R represents a hydrophobic group or a hydrophobic polymer portion, P represents a polymer portion having a polymerization degree of from 10 to 3,500 and containing at least one of the following structural units A, B and C, and n represents 1 or 2:

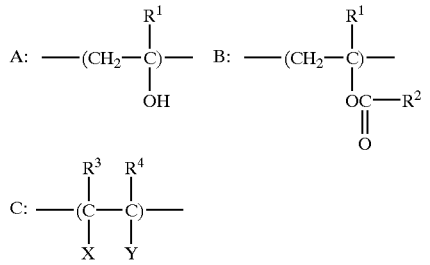

Herein, $R^1$ represents —H or an alkyl group having from 1 to 6 carbon atoms, $R^2$ represents —H or an alkyl group having 1 to 10 carbon atoms, $R^3$ represents —H or —$CH_3$, $R^4$ represents —H, —$CH_3$, —$CH_2COOH$ (including an ammonium salt and a metal salt) or —CN, X represents —H, —COOH (including an ammonium salt and a metal salt thereof) or —$CONH_2$, Y represents —COOH (including an ammonium salt and a metal salt thereof), —$SO_3H$ (including an ammonium salt and a metal salt thereof), —$OSO_3H$ (including an ammonium salt and a metal salt thereof), —$CH_2SO_3H$ (including an ammonium salt and a metal salt thereof), —$CONHC(CH_3)_2CH_2SO_3H$ (including an ammonium salt and a metal salt thereof) or —$CONHCH_2CH_2CH_2N^+(CH_3)_3Cl^-$.

In the general formula (I), $R^1$ is preferably —H, and $R^2$ is preferably —$CH_3$.

Representative examples of the compound represented by the general formula (I) include a random or block copolymer of vinyl alcohol and a vinyl ester, and the random or block copolymer of vinyl alcohol and a vinyl ester that further contains the third monomer component having an anionic group, such as a carboxyl group and the ends of the copolymer are terminated with an alkyl group or a hydrophobic polymer.

Examples of the hydrophobic group represented by R in the general formula (I) include an aliphatic group (such as an alkyl group, an alkenyl group and an alkynyl group), an aromatic group (such as a phenyl group and a naphthyl group), and an alicyclic group, and those having one or more substituents. Examples of the substituents include an aliphatic group, an aromatic group, an alicyclic group, a heterocyclic group, a halogen atom, a hydroxyl group, a cyano group, a nitro group, an N-substituted sulfamoyl group, a carbamoyl group, an acylamino group, an alkylsulfonylamino group, an arylsulfonylamino group, an alkoxy group, an aryloxy group, an aralkyl group and an acyl group.

In the case where the hydrophobic group represented by R in the general formula (I) is an alkyl group, the carbon number thereof is generally from 3 to 70, preferably from 4 to 50, and particularly preferably from 8 to 24.

Specific examples of R which is a hydrophobic group are preferably shown as groups from the (S-1) to (S-50) disclosed in the paragraphs 0034 to 0042 of JP-A No.10-95942.

In the case where R in the general formula (I) represents a hydrophobic polymer, examples thereof include a water insoluble polymer, such as polystyrene and a derivative thereof, polymethacrylate (such as polymethyl methacrylate) and a derivative thereof, polyacrylic acid ester and a derivative thereof, vinyl polymer or vinyl copolymer which is insoluble in water such as polybutene, polyvinyl acetate and polyvinyl versatate, a water insoluble polyoxyalkylene, such as polyoxypropylene and polyoxytetramethylene, and a water insoluble polyamide and polyester. In particular, polystyrene and a derivative thereof, polymethacrylate and a derivative thereof, a polyacrylate and a derivative thereof, and polyvinyl chloride are preferably used. The polymerization degree of the hydrophobic polymer is generally from 2 to 500, preferably from 2 to 200, and more preferably from 2 to 100.

The polymer P in the compound represented by the general formula (I) is a polymer containing at least one of the structural units A, B and C. Specific examples of the structural unit A constituting the polymer P include vinyl alcohol, α-methylvinyl alcohol and α-propylvinyl alcohol. Examples of the structural unit B constituting the polymer P include vinyl acetate, vinyl formate, vinyl propionate and a α-substituted compound of them. Examples of the structural unit C constituting the polymer P include acrylic acid, methacrylic acid or crotonic acid (including an ammonium salt and a metal salt thereof, such as a salt of Na or K thereof), maleic acid or itaconic acid (including an monoalkyl ester, an ammonium salt and a metal salt thereof, such as a salt of Na or K), vinylphosphonic acid, vinylsulfuric acid, acrylsulfonic acid, methacrylsulfonic acid, 2-acrylamide-3-methylpropanesulfonic acid or 2-methacrylamide-3 -methylpropanesulfonic acid (including an ammonium salt and a metal salt thereof, such as a salt of Na or K), and a monomer unit that exerts ionic dissociation in water, such as acrylamidepropyltrimethylammonium chloride and methacrylamidepropyltrimethylammonium chloride. In particular, itaconic acid and maleic acid are preferred.

Among these, a vinyl alcohol unit is more preferred as the structural unit A, a vinyl acetate unit is more preferred as the structural unit B, and a vinyl monomer unit containing a carboxylic acid (including an ammonium salt and a metal salt thereof, such as a salt of Na or K) and/or a vinyl monomer unit containing a sulfonic acid (including an ammonium salt and a metal salt thereof, such as a salt of Na or K thereof) are more preferred as the structural unit C.

The contents of the structural units A, B and C constituting the polymer P are not particularly limited. When the contents of the units A, B and C are represented by x, y and z % by mole, respectively, it is preferred that $x+y+z=100$, $0 \leqq x \leqq 100$, $0 \leqq y \leqq 75$ and $0 \leqq z \leqq 100$, and is more preferred that $x+y+z=100$, $0 \leqq x \leqq 100$, $0 \leqq y50$ and $0 \leqq z \leqq 50$. In the case where the content of the structural unit C is 1% by mole or less, it is preferred that the content of the structural unit A is from 50 to 100% by mole in order that the polymer represented by the general formula P is water soluble or water dispersible.

The compound represented by the general formula (I) in the present invention is included in a wide range of compounds from a water soluble one to a water dispersible one. The polymer P may contain other structural units than the structural units A, B and C so long as the compound represented by the general formula (I) is water soluble or water dispersible. Examples of the other structural units include such a unit as ethylene, propylene, isobutene, acrylonitrile, acrylamide, methacrylamide, N-vinylpyrrolidone, vinyl chloride and vinyl fluoride. The polymerization degree of the polymer P is generally from 10 to 3,500, preferably from 10 to 2,000, more preferably from 10 to 1,000, and particularly preferably from 10 to 500.

As the alkyl group represented by $R^1$ and $R^2$ in the structural units A and B of the polymer P, a methyl group is preferred. The alkyl group may be substituted with a substituent, such as a hydroxyl group, an amide group, a carboxyl group, a sulfone group, a sulfine group and a sulfonamide group.

The compound represented by the general formula (I) in the present invention varies in optimum chemical composition and molecular weight of P and R constituting the compound depending on the purposes of the present invention. However, in any purpose, an excellent effect can be obtained when the weight ratio of P to R is $0.001 \leqq R/P \leqq 2$, more preferably $0.005 \leqq R/P \leqq 1.5$, and more preferably $0.01 \leqq R/P \leqq 1$.

Upon spraying the latent image-forming solution in a droplet form, the foregoing materials may be appropriately selected depending on the thermal transfer material, while one kind thereof may be used solely, and two or more kinds thereof may be used as a mixture.

The transfer-promoting material is used to improve the transfer property of an optional part of the transfer recording layer formed with the thermal transfer material, whereby the transfer of the optional part is easily and completely carried out at a lower transfer temperature. At least a part of the transfer-promoting material penetrates the transfer recording layer or the image receiving layer, whereby releasing of the transfer recording layer from the support is made easy. The transfer-promoting material is preferably a liquid having such physical properties as a surface tension thereof from 20 to 60 mN/m and a viscosity of 50 mPa·s or less. The application amount of the transfer-promoting material to the transfer recording layer or the image receiving layer is preferably suppressed within a range where the resolution of the transferred image is not lowered. When the application amount is too large, there is a possibility that penetration of the transfer-promoting material and dissolution and flow of the transfer recording layer occur at an interface between the image part and the non-image part, so that the sharpness at the image interface is lowerd.

As the extent of lowering the transfer temperature, it is preferred that the transfer temperature of the original transfer recording layer is lowered by 3° C. or more due to addition of the transfer-promoting material. With respect to the above function of the transfer-promoting material, it is considered that plasticization or swelling occurs in the binder contained in the transfer recording layer or the image receiving layer.

The transfer temperature can be measured by the following manner.

In an apparatus containing a pair of heating nip rollers which have a temperature variable heating roller as shown in FIG. 1, a thermocouple is sandwiched by a transfer material and an image receiving sheet, and the temperature is measured with the thermocouple while the assembly is passed through between the heating nip rollers. The measurement is repeated with changing the heating temperature, and the lowest temperature, at which transfer occurs, is designated as the transfer temperature.

The image transfer material and the image receiving sheet used in the process according to the present invention will be described. The image transfer material in the present invention contains a support having thereon a transfer recording layer which comprises a thermal transfer material. The support and the transfer recording layer, as well as other layer provided depending on necessity, constituting the image transfer material will be described in detail below.

[Support for Image Transfer Material]

A material for the support of the image transfer material is not particularly limited, and various kinds of materials for supports may be used corresponding to the purposes. Preferred examples of the material for the support include a synthetic resin material, such as polyethylene terephthalate, polyethylene-2,6-naphthalte, polycarbonate, polyethylene, polyvinyl chloride, polyvinylidene chloride, polystyrene and a styrene-acrylonitrile copolymer. Among these, biaxially oriented polyethylene terephthalate is preferred taking the mechanical strength and the dimensional stability to heat into consideration.

It is preferred that the support is subjected to a surface roughening treatment and/or is provided with one or more undercoating layers in order to improve the adhesion to the transfer recording layer to be provided thereon. Examples of the surface roughening treatment include a glow discharge treatment and a corona discharge treatment. A material for the undercoating layer preferably exhibits high adhesiveness to both the surfaces of the support and the transfer recording layer and preferably has small thermal conductivity and excellent heat resistance. Examples of the material for the undercoating layer include styrene, a styrene-butadiene copolymer and gelatin. The total thickness of the undercoating layer is generally from 0.01 to 2 $\mu$m. On the surface of the thermal transfer sheet opposite to the side having the transfer recording layer, any kinds of functional layers, such as a releasing layer, may be provided and any kind of surface treatment may be carried out thereon, depending on necessity.

[Transfer Recording Layer]

In the case where a colored image is formed, the transfer recording layer contains at least a pigment for forming the colored image through transfer to the image receiving sheet, and the transfer recording layer further contains a binder resin for forming the layer, as well as other components depending on necessity. The transfer recording layer in the present invention is not necessarily limited to a colored recording layer but may be a colorless resin layer, for example, in the case where it is used for forming a lithographic printing plate. However, it is necessary that it has such characteristics that the transfer property thereof can be improved by the liquid transfer-promoting material.

Pigments can be roughly classified into an organic pigment and an inorganic pigment. They have such characteristics that the former is excellent in transparency of a coated film comprising them, and the later is excellent in conceal ability. Therefore, they may be appropriately selected depending on the purpose. When the image transfer material in the present invention is used as color proof for printed color correction, organic pigments preferably used are that whose hue are identical or close to yellow, magenta, cyan or black that is generally used as a printing ink. In addition to them, metallic powder, a fluorescent pigment and the like may used in the transfer recording layer. Examples of the pigment that can be preferably used include an azo pigment, a phthalocyanine based pigment, an anthraquinone based pigment, a dioxane based pigment, a quinacridone based pigment, an isoindrinone based pigment and a nitro pigment. Examples of the pigment used in the transfer recording layer are listed below as classified by hues, but the pigment usable in the present invention is not limited to the examples.

1) Yellow Pigment

Hansa Yellow G, Hansa Yellow 5G, Hansa Yellow 10G, Hansa Yellow A, Pigment Yellow L, Permanent Yellow NCG, Permanent Yellow FGL and Permanent Yellow HR 2) Red Pigment Permanent Red 4R, Permanent Red F2R, Permanent Red FRL, Lake Red C, Lake Red D, Pigment Scarlet 3B, Bordeaux 5B, Alizarin Lake and Rhodamine Lake B 3) Blue Pigment Phthalocyanine Blue, Victoria Blue Lake and Fast Sky Blue 4) Black Pigment Carbon Black As the binder resin used for the transfer recording layer, an amorphous organic polymer having a softening point of 40 to 150° C. is preferred. Examples of the amorphous organic polymer include a butyral resin, a polyamide resin, a polyethyleneimime resin, a sulfonamide resin, a polyester polyol resin, a petroleum resin, a homopolymer and a copolymer of styrene, substituted styrene or a derivative thereof, such as styrene, vinyltoluene, α-methylstyrene, 2-methylstyrene, chlorostyrene, vinyl benzoate, sodium vinylbenzenesulfonate and aminostyrene, a homopolymer or a copolymer of a vinyl monomer, such as methacrylates and methacrylic acids, e.g., methyl methacrylate, ethyl methacrylate, butyl methacrylate and hydroxyethyl methacrylate, acrylates and acrylic acids, e.g., methyl acrylate, ethyl acrylate, butyl acrylate and α-ethylhexyl acrylate, dienes, e.g., butadiene and isoprene, acrylonitrile, vinyl ethers, maleic acids, maleates, maleic anhydrode, cinnamic acid, vinyl chloride and vinyl acetate. These resins may be used singly or as a mixture of two or more.

The transfer recording layer preferably contains the pigment in an amount of 30 to 70% by mass, more preferably 30 to 60% by mass, and further preferably 30 to 50% by mass. The transfer recording layer preferably contains the resin in an amount of 70 to 30% by mass, more preferably 70 to 40% by mass, and further preferably 70 to 50% by mass.

In the case where one or more image layers (the transfer recording layers having an image formed therein) are repeatedly superposed on the same image receiving sheet to produce a multi-color image, it is preferred that the transfer recording layer contains a plasticizer to improve adhesion between the images. Examples of the plasticizer include phthalates such as dibutyl phthalate, di-n-octyl phthalate, di(2-ethylhexyl) phthalate, dinonyl phthalate, dilauryl phthalate, butyllauryl phthalate and butylbenzyl phthalate, aliphatic dibasic acid esters, such as di (2-ethylhexyl) adipate and di (2-ethylhexyl) sebacate, a phosphoric triester such as tricresyl phosphate and tri(2-ethylhexyl) phosphate, polyol polyesters such as a polyethylene glycol ester, and epoxy compounds such as an epoxy fatty acid ester. In addition to the foregoing ordinary plasticizers, acrylates such as polyethylene glycol dimethacrylate, 1,2,4-butanetriol trimethacrylate, trimethylolethane triacrylate, pentaerythritol triacrylate, pentaerythritol tetraacrylate and dipentaerythritol polyacrylate is also preferably used depending on the kind of the binder used. The plasticizer may be used singly or in combination of two or more. When image formation is repeated by plural times in order to obtain a multi-color image, the latent image-forming solution may be limitedly added to either the image transfer material or the image receiving sheet, or may be added to the both. That is, steps (i), (ii) and (iii) may be repeated with the same image receiving sheet, for obtaining a multi-color image. An example of the later case will be described herein after. In the case where, for example, an image of four colors is to be formed, image formation may be repeated four times for the respective colors. At this time, the initial latent image-forming solution may be added to the image transfer material two times and to the image receiving sheet two time among the four times, so as to complete the color image. The order and the ratio of frequency of addition may be changed depending on the conditions thereon. The latent image-forming solutions used for the respective colors may be the same as or different from each other.

The plasticizer is used in such an amount that the weight ratio of the total weight of the pigment and the resin to the weight of the plasticizer is generally from 100:1 to 100:3, and preferably from 100:1.5 to 100:2. In the transfer recording layer, a surfactant, a thickener agent and the like may be added depending on necessity.

The transfer recording layer can be provided in such a manner that a coating composition having the pigment and the binder resin dissolved or dispersed therein is prepared, and it is coated on a support (a support having the foregoing undercoating layer), followed by drying. Examples of a solvent used for preparing the coating composition include n-propyl alcohol, methyl ethyl ketone, propylene glycol monomethyl ether (MFG) and methanol. The coating and the drying may be carried out in accordance with the ordinary coating and drying method.

The layer thickness (dry thickness) of the transfer recording layer is from 0.1 to 1.5 $\mu$m, preferably from 0.3 to 1.0 $\mu$m, and more preferably from 0.4 to 0.8 $\mu$m.

The transfer-promoting material is applied imagewisely to the surface of the transfer recording layer of the image transfer material which contains the foregoing transfer recording layers laminated on a support in the aforementioned order, or to the surface of the image receiving sheet described later, whereby a latent image is formed. The transfer-promoting material is penetrated into the transfer recording layer only on the latent image portion of the thermal transfer material where the transfer-promoting material is provided. Thus, the bindings of the binder resin constituting the layer are weakened, and the bonding strength between the support and the image forming layer is lowered, so that the transfer property to the image receiving sheet of the image is improved. Therefore, the transfer can be carried out at a lower temperature.

[Image Receiving Sheet]

The image receiving sheet used in the process of the present invention generally contains a support having thereon an image receiving layer containing one or more binder resins, and it is preferred that the image receiving sheet may further contain, depending on necessity, one or two or more layers of a cushioning layer, a releasing layer and/or an intermediate layer between the support and the image receiving layer. However, when the affinity with the transfer recording layer is good, a resin sheet such as polyethylene terephthalate (PET), ordinary paper, coated paper, a glass-epoxy sheet and a metallic plate can also be used without the image receiving layer. In the case of the image receiving sheet containing a support having thereon an image receiving layer, it is preferred to provide a back layer on the surface of the support opposite to that on which the image receiving layer is provided, in order to improve the transporting property.

Examples of the support include an ordinary sheet-form base material such as a plastic sheet, a metallic sheet, a glass sheet and paper. Examples of the plastic sheet include a polyethylene terephthalate sheet, a polycarbonate sheet, a polyethylene sheet, a polyvinyl chloride sheet, a polyvinylidene chloride sheet, a polystyrene sheet, a styrene-acrylonitrile copolymer sheet and a polyester sheet. As a paper support, printing paper and coated paper can also be used.

The support preferably has minute pores (fine voids) since curling can be prevented and the image quality can be improved. Such a support can be produced, for example, in such a manner that a thermoplastic resin is mixed with a filler, such as an inorganic pigment and a polymer that is incompatible with the thermoplastic resin, to form a mixed melt, and the melt is formed into a single-layer or multi-layer film by a melt extruder, followed by subjecting uniaxial or biaxial stretching. In this case, the percentage of void (prosity) is determined by the selection of the resin and the filler, the mixing ratio and the stretching conditions.

As the thermoplastic resin, a polyolefin resin such as polypropylene and a polyethylene terephthalate resin are preferred since they are good in crystallizability and stretching property and can easily form voids. It is preferred that the polyolefin resin or the polyethylene terephthalate resin is used as a main component, and a small amount of another thermoplastic resin(s) is used in combination. As the inorganic pigment used as the filler, those having an average particle diameter of 1 to 20 $\mu$m are preferred, and calcium carbonate, clay, diatomaceous earth, titanium oxide, aluminum hydroxide, silica and the like can be used. In the case where polypropylene is used as the thermoplastic resin, polyethylene terephthalate is preferably used as the incompatible resin used as the filler.

The content of the filler, such as an inorganic pigment, in the support is generally about 2 to 30% by volume.

The thickness of the support of the image receiving sheet is generally from 10 to 400 $\mu$m, preferably from 25 to 200 $\mu$m, and more preferably from 50 to 180 $\mu$m. In order to improve the adhesiveness to the image receiving layer (or the cushioning layer) or to improve the adhesiveness to the image forming layer of the thermal transfer sheet, the surface of the support may be subjected to a surface treatment, such as a corona discharge treatment and a glow discharge treatment.

In order to transfer the image forming layer to the surface of the image receiving sheet and to fix the same thereon, it is preferred that at least one image receiving layer is provided on the support. The image receiving layer is preferably such a layer that is formed mainly with a binder resin composed of an organic polymer. The binder resin is preferably a thermoplastic resin, and examples thereof include a homopolymer or a copolymer of acrylic monomers such as acrylic acid, methacrylic acid, an acrylate and a methacrylate, a cellulosic polymer such as methyl cellulose, ethyl cellulose and cellulose acetate, a homopolymer or a copolymer of a vinyl based monomer such as polystyrene, polyvinyl pyrrolidone, polyvinyl butyral, polyvinyl alcohol and polyvinyl chloride, a condensation polymer such as polyester and polyamide, and a rubber based polymer such as a styrene-butadiene copolymer. In order to obtain appropriate adhesive strength between the image receiving layer and the image forming layer, the binder of the image receiving layer is preferably a polymer having a glass transition point (Tg) of less than 90° C. A plasticizer may be added to the image receiving layer in order to provide the glass transition point. In order to prevent blocking among the sheets, the binder polymer preferably has a Tg of 30° C. or more. As the binder polymer of the image receiving layer, the same or similar polymer as the binder polymer of the image forming layer is particularly preferably used, in order to improve the sensitivity and the image strength.

The image receiving layer is formed by coating an organic solvent solution or an aqueous liquid (including an aqueous solution and an aqueous dispersion) containing the binder resin on the support. Therefore, it has receptivity (acceptability) to the thermal transfer-promoting material unlike a support such as a plastic sheet. The receptivity or acceptability herein means, for example, that the image receiving layer is plasticized or swelled with the thermal transfer-promoting material. The transfer temperature of the thermal transfer material can be decreased due to the plasticization or swelling function.

According to the process of the present invention, an image is once formed on the image receiving layer, and then the image may be further transferred to a printing paper or the like. In this case, the image receiving sheet is used as an intermediate transfer material. The other conditions herein may be changed from the standpoint that the image is inverted.

The thickness of the image receiving layer is generally from 0.3 to 7 $\mu$m, preferably from 0.5 to 5.5 $\mu$m, and more preferably from 0.7 to 4 $\mu$m. When the thickness is less than 0.3 $\mu$m, the image receiving layer is liable to be broken upon a transfer to a printing paper due to insufficient film strength. When it is too thick, gloss of the image after a transfer to a printing paper is increased, whereby the similarity to the printed image is lowered.

The image forming process of the present invention is carried out by using the image transfer material, the image receiving sheet and the transfer-promoting material described above.

An image forming apparatus according to the present invention will be described with reference to the drawings, and the image forming process will also be described with respect to each steps.

FIG. 1 is a conceptual view showing the structure of the image forming apparatus according to the present invention.

The image forming apparatus 1 include a discharge head (nozzle head) 13 for applying a transfer-promoting material in the form of droplets to an image transfer material 5, and a pair of pressure rollers which are constituted by a supporting drum 3 for contacting the image transfer material 5 and an image receiving sheet 11 tightly to carry out transfer and a pinch roller 7 which includes a heating means. The image transfer material (transfer sheet) 5 containing a support having thereon a transfer recording layer is supported on the supporting drum 3 by winding it on a part of the outer circumference of the drum. The transfer recording layer formed on the support comprises a material, such as a pigment-based dye and metallic particles, and a binder resin. The present embodiment will be described by using a case, as an example, in which a pigment based dye is used as a transfer material.

The image transfer material 5 is supported by the support drum 3 such that the support side thereof is in contact with the supporting drum 3 and the transfer recording layer side is the surface side. In the image forming apparatus 1, the pinch roller 7 is arranged to face the supporting drum 3 with the same axis direction. The pinch roller 7 contains a heater, the temperature of which can be controlled, in the interior thereof.

The image receiving sheet 11 is inserted between the supporting drum 3 and the pinch roller 7. Between the supporting drum 3 and the pinch roller 7, the image transfer material 5 and the image receiving body 11 move in such a manner that the transfer recording layer of the image transfer material 5 and the image receiving surface of the image receiving sheet 11 are in contact with each other, and the assembly is inserted between the pressure rollers and is transported in the right hand direction in the figure by the rotation of the supporting drum 3 and the pinch roller 7 under heating. In this embodiment, the case where the image receiving sheet has a PET film used as a support will be described as an example.

The part where a latent image is formed by the transfer-promoting material has a transfer temperature that is lower than those of the surrounding part of the transfer recording layer where the transfer-promoting material is not provided. Therefore, when the heating condition of the pinch roller 7 provides such that a temperature of a contact portion wherein latent image is formed, is equal or lower than a temperature for transferring the original transfer recording layer without the transfer-promoting material but is equal or higher than a transfer temperature for transferring the latent image portion with the transfer-promoting material, image transfer can be carried out with clear contrast between the parts where the latent image is formed and the parts where the latent image is not formed (i.e., the part where the transfer-promoting material is not attached). It is preferred that the heating temperature is less than the transfer temperature of the transfer recording layer but exceeds the transfer temperature of the latent image portions.

The image forming apparatus 1 comprises the droplet discharge head 13 facing the supporting drum 3. The droplet discharge head 13 is arranged as freely movable in the cross direction of the image transfer material, for example, on a transporting rail not shown in the figure. That is, the nozzle head 13 is movable transversely to the conveyance path. The moving direction of the droplet discharge head 13 is a main scanning direction for forming an image.

The droplet discharge head 13 discharges imagewisely droplets comprising the liquid transfer-promoting material to form a latent image on the surface of the image transfer layer of the image transfer material 5 supported on the supporting drum 3. As the structure of the droplet discharge head 13, the same structure as those of an ink head used in the known ordinary ink-jet printing apparatus can be applied.

In the case where a multi-color image is formed by using the apparatus, image formation is carried out by using an image transfer materials using black (K), cyan (C), magenta (M) or yellow (Y) colors as coloring materials contained in the transfer recording layer of the image transfer material.

When a latent image for black color is formed, droplets of the transfer-promoting material are discharged from the droplet discharge head 13 to a transfer recording layer of an image transfer material 5 for black color. This step is called a latent image forming step.

The image transfer material 5 and the image receiving sheet 11 are accumulated on each other in such a manner that the transfer recording layer of the image transfer material 5 and the image receiving surface of the image receiving sheet 11 are in contact with each other, and pressure is applied to the assembly by the supporting drum 3 and the pinch roller 7. At this time, the whole surface of the image receiving sheet 11 and the image transfer material 5 is heated under the determined conditions by controlling the heating means inside the pinch roller 7, and thus only the latent image portion where the transfer-promoting material are image-wisely attached is imagewisely transferred to the surface of the transfer sheet 11. This step is called as a transfer step.

Thereafter, the image transfer material 5 is transported along the supporting drum 3 by winding in the circumferential direction, whereby the image transfer material 5 is released from the image receiving sheet 11 to form a black image on the surface of the image receiving sheet 11.

By using the image transfer materials 5 for cyan, magenta and yellow colors, the transfer recording layers of the respective colors can be transferred one by one on the same image receiving sheet 11 based on the image information in the similar manner, followed by fixing, whereby a full color image is formed by accumulating four colors.

According to the image forming process using the image forming apparatus 1, due to heating of the whole surfaces of the image transfer material 5 and the image receiving sheet 11, the transfer property of only the latent image portion where the transfer-promoting material is attached is increased, and thus only the latent image portion can be selectively transferred to the transfer sheet 11 and fixed thereto. Therefore, a uniform excellent image can be formed without unevenness in thermal conduction due to resistance unevenness and contact unevenness of the thermal head and thickness unevenness of the support, which occurs in the conventional releasing transfer method.

Furthermore, because a pigment based dye can be used in the transfer recording layer, a wide variety of pigment based dyes can be selected, and there is no need to select the pigments or dyes in accordance with restrictions on physical property such as those in an ink for the ink-jet recording method. Therefore, desired colors can be selected and formed, and hue reproducibility is excellent. Further, because any of pigments excellent in light resistance, metallic pigments, a functional pigments and the like can be arbitrarily selected, an image excellent in durability and an image having a desired hue and a desired function can be formed. Consequently, the process and the apparatus of the present invention can be suitably applied to a color proof, in which the hue reproducibility is important.

Another embodiment of the image forming apparatus according to the present invention will be described.

Figure 2:
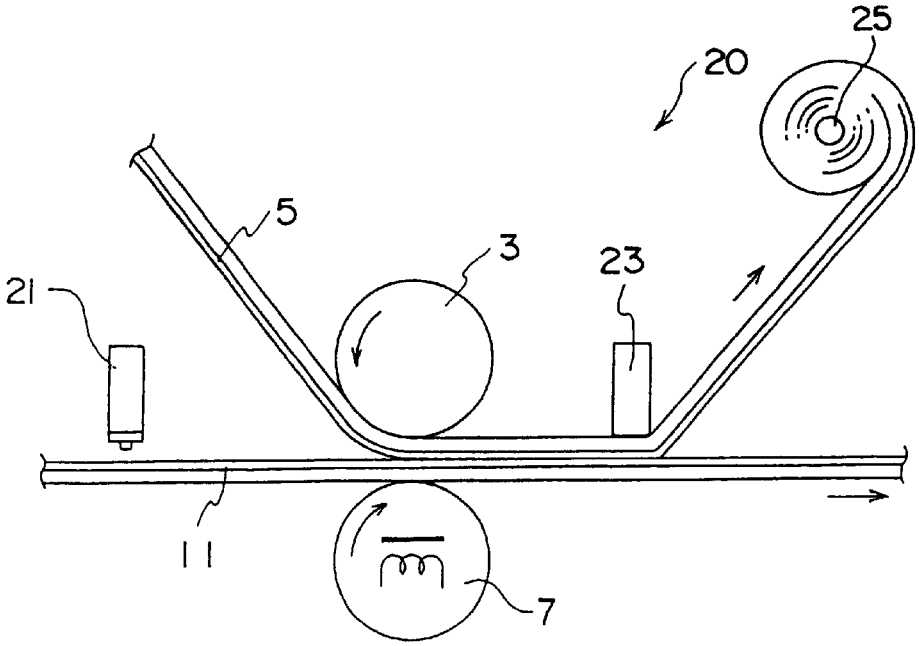
FIG. 2 is a conceptual view showing one embodiment of an image forming apparatus according to the present invention, wherein a discharge head is arranged at the side of an image receiving sheet.

FIG. 2 is a view showing a second embodiment of the structure of the image forming apparatus according to the present invention.

The image forming apparatus 20 comprises a discharge head 21 for applying a transfer-promoting material in the form of droplets to an image receiving sheet 11, a pair of pressure rollers containing a supporting drum 3 and a pinch roller 7 comprising a heating means for closely contacting the image transfer material 5 and an image receiving sheet 11 to carry out transfer, and a releasing bar 23 as a stripping member (peeling member) for peeling the image transfer material 5 and the image receiving sheet 11 which are in close contact after the transfer step.

In the image forming apparatus 20 in this embodiment, a peeling bar (stripping bar) 23 is provided at the conveying direction on the downstream side of the supporting drum 3, and presses the image transfer material 5 toward the image receiving sheet 11. The image transfer material 5 is wound at a predetermined tension between the releasing bar 23 and a winding means 25 for the image transfer material 5. Furthermore, the image transfer material 5 after passing the releasing bar 23 is released at an angle near right angle with respect to the image receiving sheet 11.

According to the image forming apparatus 20 thus formed, because the support of the image transfer material 5 is bent at an approximate right angle at the peeling bar 23, peeling of the support from the transfer material is promoted owing to the difference in bending radius, whereby the transfer recording layer can be satisfactorily fixed on the surface of the image receiving sheet 11.

The image forming apparatus 20 comprises a droplet discharge head 21 facing the supporting drum 3. The droplet discharge head 21 is freely movable in the width direction of the image receiving sheet 11. This embodiment has the same structure as the foregoing image forming apparatus 1 except that the discharge head 21 discharges droplets toward the image receiving sheet 11, and the peeling bar 23 for stably peeling the image transfer material 5 from the image receiving sheet 11 is provided. The droplet discharge head 21 discharges imagewisely droplets of the transfer-promoting material on the surface of the image receiving sheet 11 to form a latent image, and the image receiving sheet 11 is in close contact with the surface of the transfer recording layer of the image transfer material 5 which is supported by the supporting drum 3, whereby the transfer property of the transfer recording layer is increased on the part where the latent image is formed.

In this embodiment, because the transfer-promoting material is discharged to the image receiving sheet 11 but not to the transfer recording layer, reduction of the positional accuracy due to problems involved in discharging can be suppressed even when a thin transfer recording body (image transfer material) is used.

According to the image forming process of the present invention, a latent image is formed with the transfer-promoting material, and the transfer recording layer itself on the part where the latent image is formed is transferred to the image receiving sheet and fixed to form an image. Therefore, without concern for the bleeding of an ink, an image having excellent resolution and hue reproducibility can be formed, in comparison with an image formed by discharging an ink. Furthermore, as described above, the latent image formed with the transfer-promoting material can has the similar effect when it is formed either on the surface of the transfer recording layer of the image transfer material 5 or on the image receiving surface of the image receiving sheet.

A modified example of the image forming apparatus according to the present invention will be described.

Figure 3:
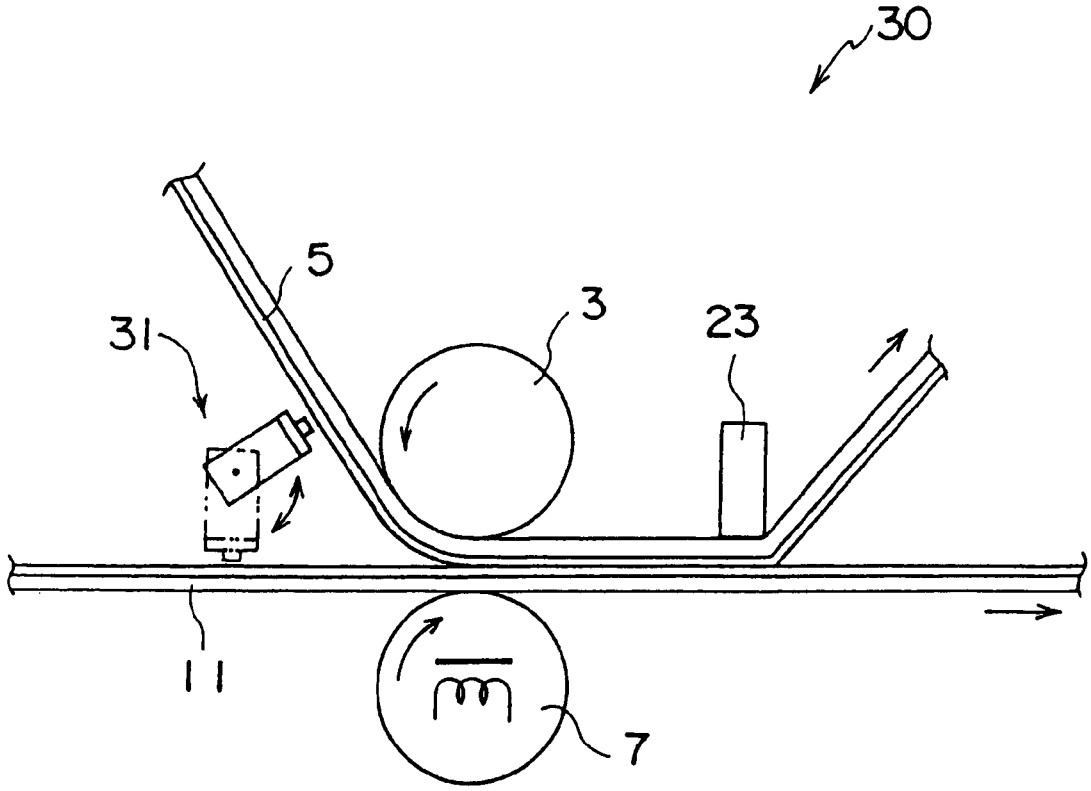
FIG. 3 is a conceptual view showing one embodiment of an image forming apparatus according to the present invention, wherein a direction of a discharge head is provided to be switchable.

In an image forming apparatus 30 according to the present invention as shown in FIG. 3, the discharging direction of the droplet discharging head can be freely switched, whereby the direction of discharging droplets of the droplet discharge head can be either the image transfer material 5 or the image receiving sheet 11, and thus the discharging direction can be appropriately changed depending on the materials and the transfer conditions.

Examples of the direction switching structure of the droplet discharge head 31 include such a structure that a droplet discharge head 31 having single or plural discharge holes is arranged rotatablly (as shown in FIG. 3), and such a structure that discharge holes are provided for the respective directions, and the discharge holes in one of the directions are opened or closed depending on necessity.

According to the image forming apparatus 30, a latent image can be formed any one of the image transfer material 5 and the image receiving sheet 11 based on compatibility of the droplets and the image transfer material 5 or the image receiving sheet 11, by switching the droplet discharging direction of the droplet discharge head 31 to one preferred latent image forming surface.

In the image forming process according to the present invention, it is preferred that the process further contains a step of heat drying the image receiving surface of the image receiving sheet after the transfer step. Owing to the drying step, the remaining solvent for forming the latent image is evaporated. As a result, when an image transfer material of another color is superposed on the image of the image receiving sheet in order to transfer another color image, secondary color fogging can be avoided and an image of high image quality can be obtained.

Figure 4:
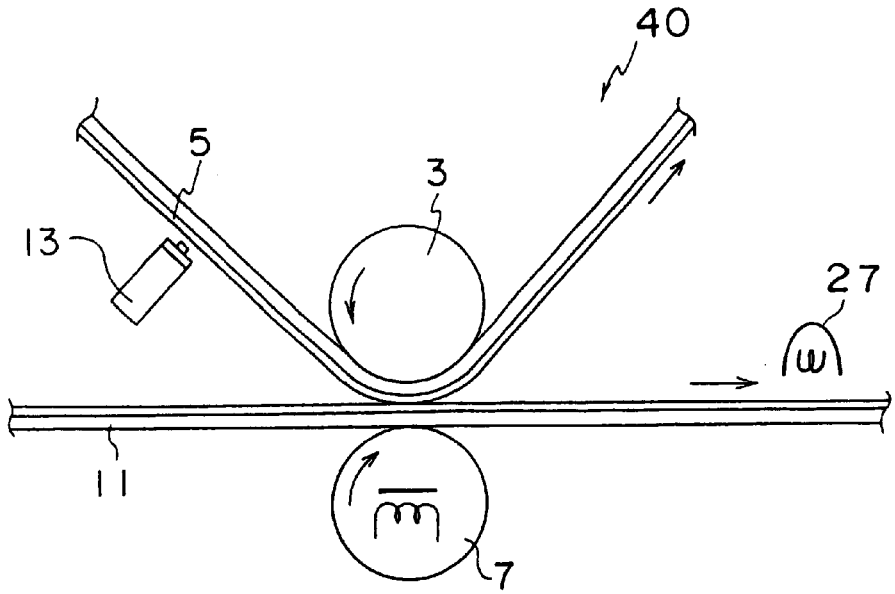
FIG. 4 is a conceptual view showing one embodiment of an image forming apparatus according to the present invention, wherein a heat-drying device is added to the image forming apparatus shown in FIG. 1.
Figure 5:
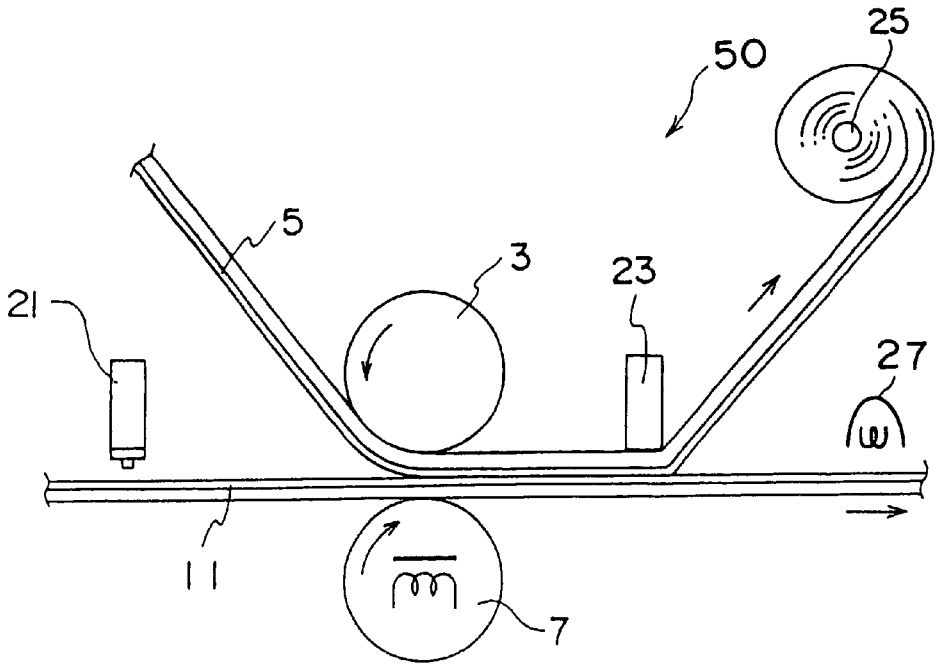
FIG. 5 is a conceptual view showing one embodiment of an image forming apparatus according to the present invention, wherein a heat-drying device is added to the image forming apparatus shown in FIG. 2.

Examples of the image forming apparatus to achieve the foregoing process include apparatuses for forming an image comprising a heat drying device as shown in FIGS. 4 and 5.

In an image forming apparatus 40 shown in FIG. 4, a heat drying device 27 is provided to the image forming apparatus shown in FIG. 1 on the downstream side of the transfer position. In an image forming apparatus 50 shown in FIG. 5, a heat drying device 27 is provided in the image forming apparatus shown in FIG. 2 on the downstream side with respect to the releasing bar 23.

Further, while not shown in the figures, after the transfer-promoting material is applied imagewisely to the image transfer material or the image receiving sheet and before the transfer, the applied surface may be preferably dried by heating for preventing reduction in resolution.

A multi-color image may be obtained by arranging a plurality of the apparatuses for forming an image according to the present invention. In this case, the image receiving sheet is continuously supplied.

As another application of the image forming process according to the present invention, a drum plate having a plate wherein print is formed thereon can be produced with a small number of steps in the following manner. An image transfer material 5 containing a support having thereon a lipophilic resin layer is used, and a drum-shaped plate body whose outer peripheral surface is a printing surface is used instead of the image receiving sheet 11. By conducting the same image formation operation by using these materials, a desired fine image can be formed on a curved surface such as the outer peripheral surface of the drum plate.

As a modified example of the discharge head, the same effect can be obtained in such an embodiment that a head capable of discharging a liquid transfer-promoting material in a planar form or a linear form is used but not a droplet discharge type, and a mask having imagewise transmission holes formed therein is arranged between the droplet discharge head and the image transfer material or the image receiving sheet. Examples of the means for discharging droplets in a planar form include those having plural discharge holds or having a diffusion nozzle, and examples of the means for discharging droplets in a linear form include such an embodiment that discharging holes linearly arranged in the main scanning direction are moved in the subscanning direction.

According to the apparatuses for forming an image, formation of an image can be carried out at a high speed since the droplets are discharged in a planar form.

EXAMPLES

The present invention will be described in more detail with reference to the following examples, but the present invention is not limited thereto. In the examples, all the "parts" are "parts by mass", and all "percents" are "percents by mass" unless otherwise indicated.

Example 1

| Production of Image Transfer Material<br>Preparation of transfer recording layer coating composition | |
|---|---|
| Butyral resin<br>(Esrek FPD-1, produced by Sekisui Chemical Co., Ltd.) | 12.0 parts |
| Magenta pigment<br>(Leonol Red LX-235, produced by Toyo Ink Mfg. Co., Ltd.) | 12.0 parts |
| n-Propyl alcohol | 110.4 parts |
| Dispersion aid | 0.8 part |

(Solspass S-20000, produced by ICI Japan Ltd.)

10 parts of a dispersion obtained by sufficiently dispersing the foregoing components in a disperser was diluted with 0.24 part of stearic acid amide and 60 parts of n-propyl alcohol. The diluted composition was coated on a polyester film having a thickness of 5 $\mu$m and whose reverse surface was subjected to releasing treatment, so as to form a transfer recording layer having a dry thickness of 0.38 $\mu$m, whereby an image transfer material was obtained.

{Production of Image Receiving Sheet}

| Coating composition for first layer | |
|---|---|
| Vinyl chloride-vinyl acetate copolymer<br>(Solvain CL2, produced by Nisshin Chemical Industry Co., Ltd.) | 160 parts |
| Ethylene-vinyl acetate copolymer<br>(Elvaloy 742, produced by Mitsui Du Pont Chemical Co., Ltd.) | 61 parts |
| Polyeste sebacate<br>(FN-G25, produced by Nippon Soda Co., Ltd.) | 28 parts |
| Perfluoroalkyl group-containing oligomer<br>(Megafack F-178K, produced by Dainippon Ink and Chemicals, Inc.) | 4 parts |
| Methyl ethyl ketone | 630 parts |
| Toluene | 210 parts |
| Dimethylformamide | 30 parts |
| 55 Coating composition for second layer} | |
| Polyvinyl butyral resin<br>(Denka Butyral #2000-L, produced by Denki Kagaku Kogyo Co., Ltd.) | 16 parts |
| N,N-dimethylacrylamide-butyl acrylate copolymer | 4 parts |
| Perfluoroalkyl group-containing oligomer<br>(Megafack F-177K, produced by Dainippon Ink and Chemicals, Inc.) | 0.5 part |
| n-Propyl alcohol | 200 parts |

The coating composition for the first layer was coated on a PET film support having a thickness of 130 $\mu$m by using a rotary coater and dried at 100° C. adjusted to have a film thickness of 20 μm after drying. The coating composition for the second layer was coated on the first coating layer by using a rotary coater and dried at 100° C. to make the second layer having a thickness of 2 μm, whereby the image receiving body was produced.

| {Preparation of Low Concentration Latent image-forming solution} | |
|---|---|
| Distilled water | 52 parts |
| n-Propyl alcohol | 45 parts |
| Polyoxyethylene(4) lauryl ether | 3 parts |
| {Preparation of High Concentration Latent image-forming solution} | |
| Distilled water | 50 parts |
| n-Propyl alcohol | 45 parts |
| Polyoxyethylene(4) lauryl ether | 5 parts |

Image formation was carried out by using the high concentration latent image-forming solution for a highlight printed part and a minute image portion, and by using the low concentration latent image-forming solution for a high gradation portion and/or a high image density portion.

A group of nozzles shown in FIG. 6 was used as the nozzle. Four lines in the X direction and 12 lines in the Y direction of nozzles, i.e., 48 nozzles in total, were arranged with an interval (the center distance between the adjacent two nozzles) of 2.3 mm in both the X direction and the Y direction. The bore diameter of the nozzles was 20 μm.

By using an image forming apparatus 1 which was the same as that shown in FIG. 1, as shown as FIG. 1, the image transfer material 5 with the surface of the transfer recording layer facing downward and the image receiving sheet 11 with the image receiving surface facing upward were laminated and passed between the supporting drum 3 and the pinch roller 7.

At this time, before the lamination, the two kinds of latent image forming solutions (surface tension: 25.6 to 25.5 mN/m, viscosity: 2.0 to 1.8 mPa·s) were sprayed image-wisely on the surface of the transfer recording layer of the image transfer material 5 from the discharge head 13 to form a latent image. After passing through the pressure rollers having a surface temperature adjusted to 75° C., the transfer body and the image receiving body were peeled each other. The transfer recording layer was transferred onto the image receiving surface corresponding to the part where the latent image was formed, whereby an image was obtained. The resulting image was uniform without color unevenness and was of good hue resolution in all the high light portion, the minute dots and minute lines part, the high gradation portion and the high image density portion, and the image receiving sheet was free of wrinkling and distortion. In the case where the image transfer material and the image receiving sheet were passed through the apparatus (the surface temperature of the pinch roller of which was set at 75° C.), the temperature of the transfer part (measured by sandwiching a sensor between the image transfer material and the image receiving sheet) was 61° C.

In order to measure the transfer temperatures in the cases where the transfer-promoting material solution was attached and was not attached, measurements were carried out by varying the surface temperature of the pinch roller of the apparatus. As a result, the transfer temperatures at the transfer part were 47° C. when the liquid was attached and 76° C. when the liquid was not attached.

Example 2

Image formation was carried out by using the two kinds of latent image-forming solution used in Example 1 with varying the resolution setting. In the case where the resolution was 360 dpi, the high concentration latent image-forming solution was used, and in the case where the resolution was 720 dpi, the low concentration latent image-forming solution was used. Satisfactory images were obtained in both the cases.

Example 3

Image formation was carried out in the same manner as in Example 1 except that the latent image-forming solution was replaced by the following ones.

| {Low Concentration Latent image-forming solution} | |
|---|---|
| Distilled water | 70 parts |
| Ethylene-vinyl acetate copolymer latex (solid content: 50%) | 30 parts |
| {High Concentration Latent image-forming solution} | |
| Distilled water | 60 parts |
| Ethylene-vinyl acetate copolymer latex (solid content: 50%) | 40 parts |

As similar to Example 1, the resulting image was uniform without color unevenness and was of good hue resolution in all the high light portion, the minute dots and minute lines part, the high gradation portion and the high image density portion, and the image receiving sheet was free of wrinkling and distortion.

Example 4

Image formation was carried out by using the two kinds of latent image-forming solution used in Example 3 with varying the resolution setting. In the case where the resolution was 360 dpi, the low concentration latent image forming solution was used, and in the case where the resolution was 720 dpi, the high concentration latent image-forming solution was used. Satisfactory images were obtained in both the cases.

As described in the foregoing, according to the image forming process of the present invention, the range of selection of the image transfer material can be largely broadened, the process can be applied to image formation with a light-resistant pigment and a functional inorganic material, and an image having good hue reproducibility can be formed, as disclosed in Japanese Patent Application Nos.12-163273 and 11-288179. Further, the influence of the temperature distribution caused by the thickness unevenness of the support, the contact unevenness with the thermal head and the diffusion unevenness of heat can be avoided, and a uniform image without color unevenness can be formed. Furthermore, the image receiving sheet receives less damage since the transfer temperature is lowered. By using plural kinds of liquids having different concentrations are used as the latent image-forming solution, satisfactory image formation can be carried out irrespective as to whether the image forming region is a high light portion and/or a microimage portion, or a high gradation portion and/or a high image density portion, and irrespective as to whether the image formation is carried out with high resolution setting or low resolution setting.

What is claimed is:

1. An image forming process comprising:

(i) preparing an image receiving sheet, an image transfer material and at least two latent image-forming solutions, the image receiving sheet comprising an image receiving layer which contains a binder resin, the image transfer material comprising, on a support, a transfer recording layer which comprises a thermal transfer material, the latent image-forming solutions respectively comprising at least one of an adhesive material and a transfer-promoting material which is capable of lowering a transfer temperature of the thermal transfer material, one of the latent image-forming solutions having a lower concentration of the at least one of an adhesive material and a transfer-promoting material than another of the latent image-forming solutions;

(ii) forming a latent image by imagewisely applying the latent image-forming solutions from a plurality of nozzles to at least one of a transfer recording layer surface of the image transfer material and an image receiving layer surface of the image receiving sheet; and (iii) transferring the portion of the transfer recording layer that corresponds to the latent image to the image receiving sheet, by contacting and heating the transfer recording layer surface with the image receiving layer surface.

2. The image forming process according to claim 1, wherein the step of forming a latent image comprises at least one sub-steps of:

discharging the higher concentration latent image-forming solution to an image formation region that includes at least one of a high light portion and a minute image portion; and discharging the lower concentration latent image-forming solution to an image formation region that includes at least one of a high gradation portion and a high image density portion.

3. The image forming process according to claim 1, further comprising the step of selecting one of a high resolution setting and a low resolution setting.

4. The image forming process according to claim 1, wherein the step of forming latent image comprises the sub-steps of:

discharging the low concentration latent image-forming solution when a higher resolution image is to be produced; and discharging the higher concentration latent image-forming solution when a lower resolution image is to be produced.

5. The image forming process according to claim 1, wherein the plurality of nozzles includes nozzles of different types, and the step of forming a latent image includes applying the higher concentration latent image-forming solution from one of the nozzle type, and applying the lower concentration latent image-forming solution from another of the nozzle types.

6. The image forming process according to claim 1, wherein the higher concentration latent image-forming solution is applied from smaller nozzles, and the lower concentration latent image-forming solution is applied from larger nozzles.

7. The image forming process according to claim 1, wherein concentration ratio of the higher concentration latent image-forming solution to the lower concentration latent image-forming solution is from 1.2:1 to 10:1.

8. The image forming process according to claim 1, wherein, if there are three of the latent image-forming solutions, the concentration ratio between the three latent image-forming solutions is 1:1.2–3:5–10.

9. The image forming process according to claim 1, further comprising the step of, after the step of transferring the portion that corresponds to the latent image, peeling the image transfer material and the image receiving sheet away from one another.

10. Ther image forming process according to claim 1, wherein, in the step of forming a latent image, the latent image-forming solution is applied substantially only to the image receiving layer surface.

11. The image forming process according to claim 1, wherein, in the step of forming a latent image, the latent image-forming solution is applied substantially only to the transfer recording layer surface.

12. The image forming process according to claim 1, further comprising the step of repeating steps (i), (ii) and (iii), with the same image receiving sheet, for obtaining a multi-color image.

13. The image forming process according to claim 1, further comprising the step of selecting a gradation setting, wherein the step of forming a latent image includes performing at least one of main scanning and subscanning of the surface on which the latent image is being formed at a speed in accordance with the selected gradation setting.

14. The image forming process according to claim 1, wherein the transfer-promoting material comprises at least one of a surfactant and an organic solvent having a boiling point of 100° C. or more under ordinary temperature and ordinary pressure and being compatible with water.

15. The image forming process according to claim 1, wherein the transfer-promoting material comprises a material such that a transfer temperature of a portion of the transfer recording layer to which the transfer-promoting material has been applied is lower than a transfer temperature of a portion of the transfer recording layer that is free of the transfer-promoting material by at least 3° C.

16. An image forming apparatus for imagewisely transferring a transfer recording layer of an image transfer material to an image receiving sheet, the image transfer material comprising the transfer recording layer on a support, the transfer recording layer comprising a thermal transfer material, and the image receiving sheet comprising an image receiving layer that contains a binder resin, the apparatus comprising:

a nozzle head including a plurality of nozzles supplied with at least two latent image-forming solutions and disposed to discharge the latent image-forming solutions towards at least one of a transfer recording layer of the image transfer material and an image receiving layer surface of the image receiving sheet, the latent image forming solutions respectively including at least one of an adhesive material and a transfer-promoting material which is capable of lowering a transfer temperature of the thermal transfer material, the latent image forming solutions having different concentrations; and a pair of pressure rollers disposed on the conveyance path downstream of the nozzle head such that when the pressure rollers are rotated the image transfer material and the image receiving sheet are passed between the pressure rollers with the transfer recording layer surface and the image receiving layer surface being pressed together, at least one of the pressure rollers including heating means whose heating temperature is controllable.

17. The image forming apparatus according to claim 16, wherein the nozzle head is movable transversely to the conveyance path.

18. The image forming apparatus according to claim 16, further comprising a peeling member down stream from the pressure rollers for aiding to peel the image transfer material and the image receiving sheet away from one another.

19. The image forming apparatus according to claim 16, wherein the nozzle head is selectively switchable for one of discharging the latent image-forming solutions towards the image transfer material and discharging the latent image-forming solution towards the image receiving sheet.

20. The image forming apparatus according to claim 16, further comprising a heat drying device disposed downstream from the pressure rollers.

* * * * *